US006883356B1

(12) United States Patent
Wu

(10) Patent No.: US 6,883,356 B1
(45) Date of Patent: Apr. 26, 2005

(54) TRANSMISSION APPARATUS FOR HOLDING A LOCK CORE OF A SUPPLEMENTAL LOCK

(75) Inventor: Wen-Pin Wu, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/814,230

(22) Filed: Apr. 1, 2004

(51) Int. Cl.[7] ..... E05B 9/04; E05B 15/04
(52) U.S. Cl. ..... 70/379 R; 70/372; 70/449
(58) Field of Search ..... 70/379 R, 372–373, 70/375, 380, 449

(56) References Cited

U.S. PATENT DOCUMENTS

| | | | | | |
|---|---|---|---|---|---|
| 437,939 | A | * | 10/1890 | Sargent | 70/375 |
| 1,707,643 | A | * | 4/1929 | Segal | 70/373 |
| 3,286,773 | A | * | 11/1966 | Russell et al. | 70/372 |
| 3,404,549 | A | * | 10/1968 | Best | 70/379 R |
| 3,541,820 | A | * | 11/1970 | Best | 70/379 R |
| 4,254,648 | A | * | 3/1981 | Dietrich | 70/380 |
| 5,229,747 | A | * | 7/1993 | Zhao | 70/380 |
| 5,233,851 | A | * | 8/1993 | Florian | 70/379 R |
| 5,884,512 | A | * | 3/1999 | Wayne | 70/379 R |
| 6,122,943 | A | * | 9/2000 | DaWalt et al. | 70/379 R |

* cited by examiner

*Primary Examiner*—Daniel P. Stodola
*Assistant Examiner*—Christopher Boswell
(74) *Attorney, Agent, or Firm*—Hershkovitz & Associates; Abe Hershkovitz

(57) ABSTRACT

A transmission apparatus to hold a lock core of a supplemental lock includes an inner housing, a lock coupler, a latch bolt coupler, a restitution element and a cover. The inner housing has a lock core chamber. The lock coupler is rotatably mounted in the lock core chamber and includes a rotatable outer disk coupler and two lock coupling arms. The outer disk coupler has a flat edge. The lock coupling arms connect to the lock core that rotates the outer disk coupler. The latch bolt coupler is rotated by the lock coupler and includes a latch coupling arm and a longitudinal tab. The restitution element is mounted around the latch coupling arm. The cover is attached to the rear of the inner housing. Consequently, the flat edge abuts the longitudinal tab that rotates the latch coupling arm when the outer disk coupler is rotated.

6 Claims, 8 Drawing Sheets

TRANSMISSION APPARATUS FOR HOLDING A LOCK CORE OF A SUPPLEMENTAL LOCK

BACKGROUND OF THE INVENTION

1. Field of the Invention

The present invention relates to a transmission apparatus that holds a lock core of a lock, and more particularly to a transmission apparatus that aids precise installation of a lock core in an supplemental lock.

2. Description of Related Art

Generally, normal house and room doors need more than one lock to provide high security. Door locks are available in a variety types and structures for different applications. Trumpet locks, lever locks, doorknob locks and supplemental locks are commonly used to lock doors.

Trumpet locks, lever locks and doorknob locks are the primary locks used to lock doors. Supplemental locks provide security for doors in addition to the primary locks where the primary locks are part respectively of the doors or the doorknobs.

With reference to FIGS. 10 and 11, a conventional apparatus to hold a lock core (not shown) of a supplemental lock comprises a housing (50), an outer disk (52), a latch bolt coupler (53) and an inner disk (54).

The housing (50) has a front (not numbered), a rear (not numbered), a lock core chamber (51), a front opening (511) and a rear opening (512). The lock core chamber (51) holds a lock core (nor shown). The front opening (511) is defined in the front and communicates with the lock core chamber (51) and through which a lock core is mounted in the lock core chamber (51). The rear opening (512) is defined in the rear and communicates with the lock core chamber (51).

The inner disk (54) is rotatably mounted in the lock core chamber (51), is rotated by the lock core and comprises a rotatable base (541) and two lock coupling arms (542). The base (541) has a central though hole (543). The central through hole (543) is defined completely though the base (541) and has a keyway (544). The lock coupling arms (542) protrude longitudinally from the base (541) toward the front opening (511), are parallel to each other, connect to the lock core and are rotated by the lock core.

The outer disk (52) is rotatably mounted on the rear of the housing (50), covers the rear opening (512) and has a disk (520) and a protrusion (521). The disk (520) covers the rear opening (512) and has a rectangular through hole (522). The protrusion (521) extends from the disk (520) and is rotatably held in the rear opening (512). The rectangular through hole (522) is defined completely through the disk (520) and is aligned with the central through hole (543) in the base (541).

The latch bolt coupler (53) comprises a rectangular driving rod (531), an enlarged head (532) and a key (533). The rectangular driving rod (531) has an inside end (534) and an outside end (535). The enlarged head (532) and the key (533) are formed at the inside end (534), and the key (533) is aligned with and engages the keyway (544) in the base (541). The outside end (535) extends into the central through hole (543) in the base (541) and the rectangular through hole (522) in the disk (520) and extends out of the rectangular through hole (522) to connect to a latch bolt (not shown) to drive the latch bolt. The enlarged head (532) abuts the base (541) of the inner disk (54). The inner disk (54) will rotate the latch bolt coupler (53) that drives the latch bolt when the lock core rotates the inner disk (54).

However, assembling the conventional transmission apparatus that holds the lock core is inconvenient. First, the outer disk (52) must be mounted on the rear of the housing (50) with the protrusion (521) rotatably held in the rear opening (512). Then the inner disk (54) and the latch bolt coupler (53) can be mounted in the lock core chamber (51), and the outside end (535) of the driving rod (531) extends into the central through hole (543) in the base (541) and the rectangular through hole (522) in the disk (520) and extends out of the rectangular through hole (522) to connect to the latch bolt. Then the lock core is mounted in the lock core chamber (51) and connected to the lock coupling arms (542) to drive the latch bolt coupler (53) through the inner disk (54).

Since the outer disk (52), the latch bolt coupler (53) and the inner disk (54) are individually attached to the housing (50), the three elements do not mutually hold each other in position during the assembly of the apparatus. The outer disk (52), the latch bolt coupler (53) and the inner disk (54) cannot be efficiently held in position in the housing (50) before the lock core is mounted in the lock core chamber (51). This adversely influences the assembly and quality of the supplemental lock.

To overcome the shortcomings, the present invention provides an improved transmission apparatus that holds a lock core of a supplemental lock to mitigate or obviate the aforementioned problems.

SUMMARY OF THE INVENTION

The main objective of the invention is to provide a transmission apparatus to hold a lock core of a supplemental lock, which makes assembly of the entire transmission apparatus and installation of the lock core convenient.

The transmission apparatus to hold a lock core of a supplemental lock in accordance with the present invention includes an inner housing, an inner disk, a lock coupler, a latch bolt drive, a restitution element and a cover. The inner housing has a lock core chamber defined completely through the inner housing to hold the lock core. The lock core chamber has an inner shoulder. The inner disk rotatably abuts the inner shoulder in the inner housing. The lock coupler is attached to the inner disk and includes a rotatable outer disk coupler and two lock coupling arms. The outer disk coupler has a flat edge. The lock coupling arms extend from the outer disk coupler toward the inner disk and penetrate the inner disk to connect to the lock core. The latch bolt coupler is rotated by the lock coupler and includes a latch coupling arm with an inner end and an outer end, and a longitudinal tab formed at the inner end. The restitution element is mounted around the latch coupling arm of the latch bolt coupler to provide a restitution force to hold the latch bolt coupler in place. The cover is attached to the rear of the inner housing to compress the restitution element. Consequently, the flat edge will abut the longitudinal tab and rotate the latch coupling arm when the outer disk coupler is rotated. The entire transmission apparatus is convenient to assemble.

Other objectives, advantages and novel features of the invention will become more apparent from the following detailed description when taken in conjunction with the accompanying drawings.

BRIEF DESCRIPTION OF THF DRAWINGS

Figure 6:
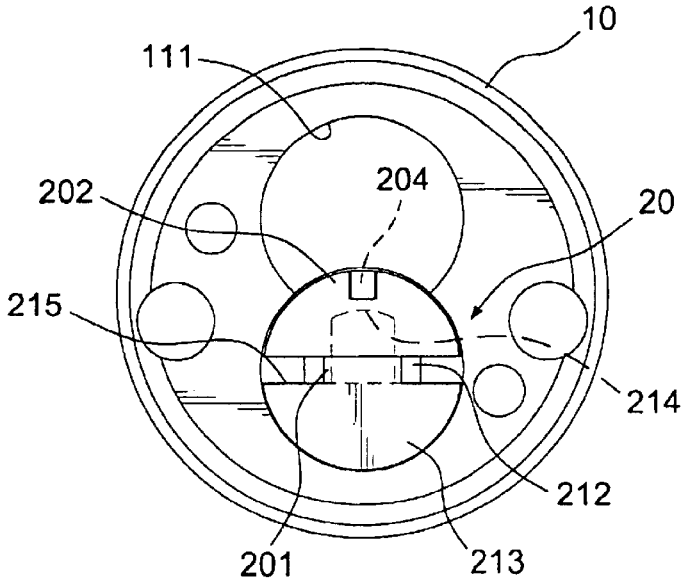
FIG. 6 is an operational rear plan view of the transmission apparatus in FIG. 1 when an outer semicircular coupling disk is in its original position.
Figure 7:
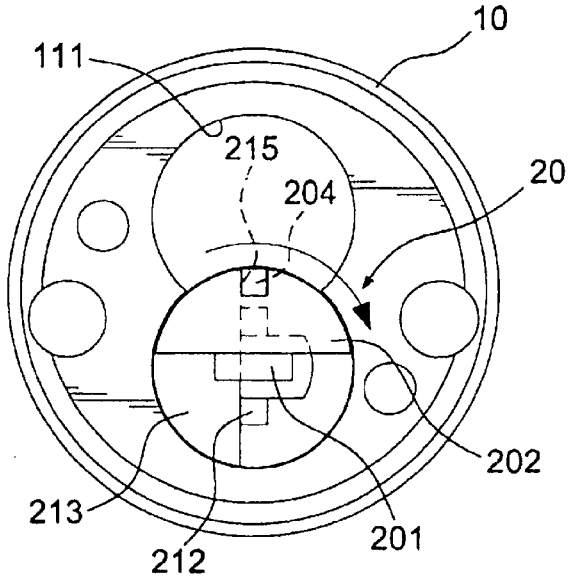
Figure 8:
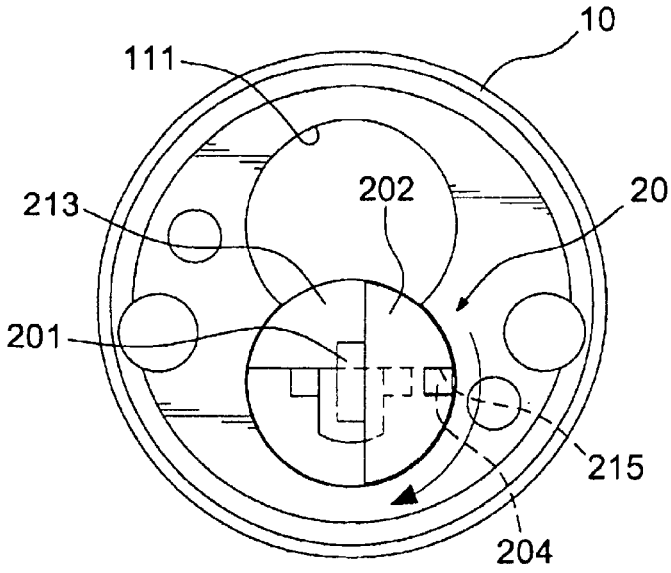
Figure 9:
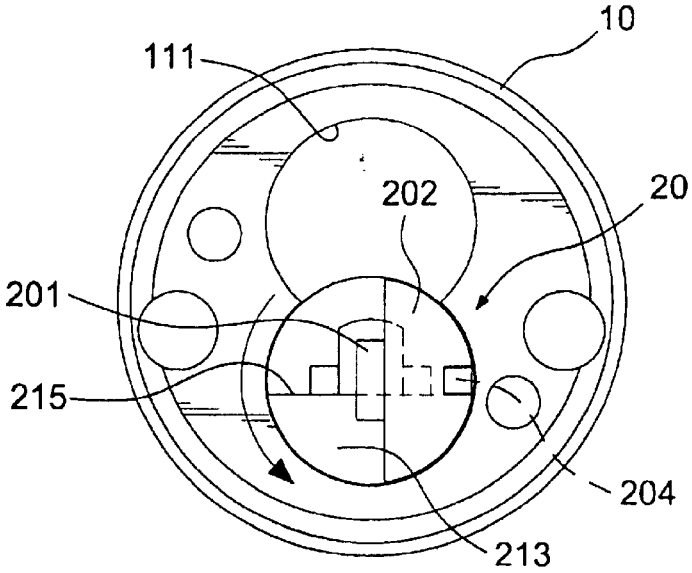
Figure 10:
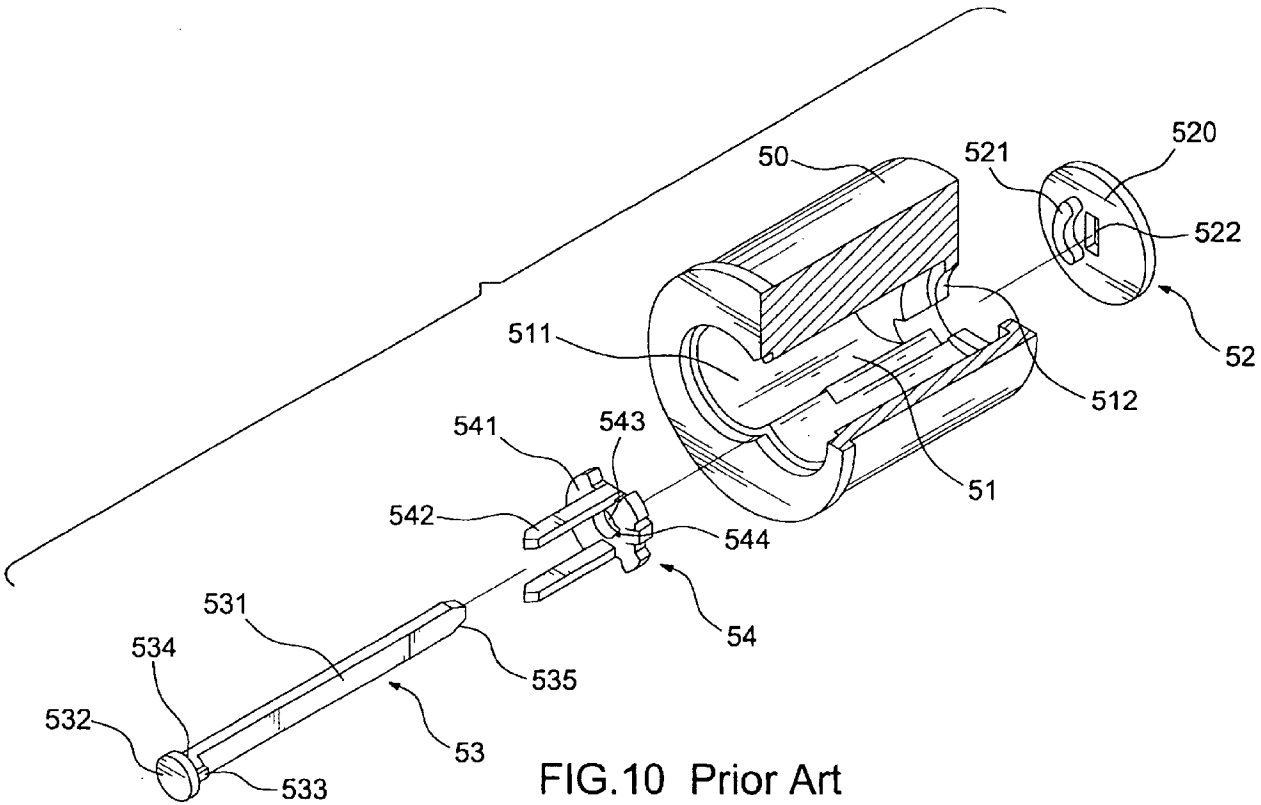
FIG.10 Prior Art
Figure 11:
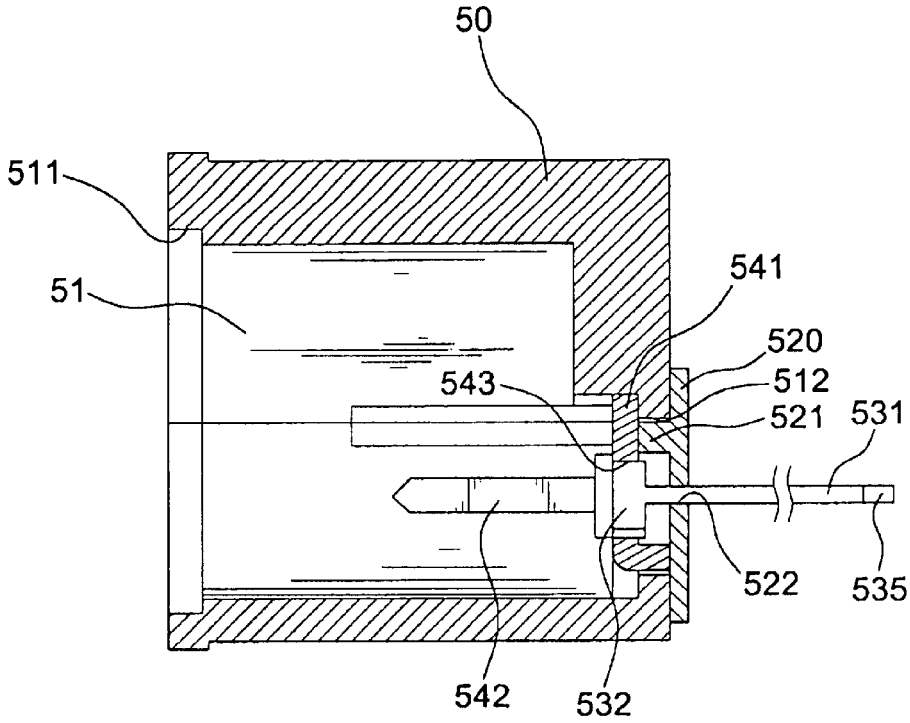
FIG.11 Prior Art

FIG. 7 an operational rear plan view of the transmission apparatus in FIG. 6 when the outer semicircular coupling disk is rotated 90 degrees clockwise;

FIG. 8 an operational rear plan view of the transmission apparatus in FIG. 6 when the outer semicircular coupling disk is rotated 180 degrees clockwise;

FIG. 9 an operational rear plan view of the transmission apparatus in FIG. 8 when the outer semicircular coupling disk is rotated 180 degrees counterclockwise;

FIG. 10 is an exploded perspective view in partial section of a conventional transmission apparatus in accordance with the prior art; and FIG. 11 is a cross sectional plan view of the conventional transmission apparatus in FIG. 10.

DETAILED DESCRIPTION OF PREFERRED EMBODIMENT

Figure 1:
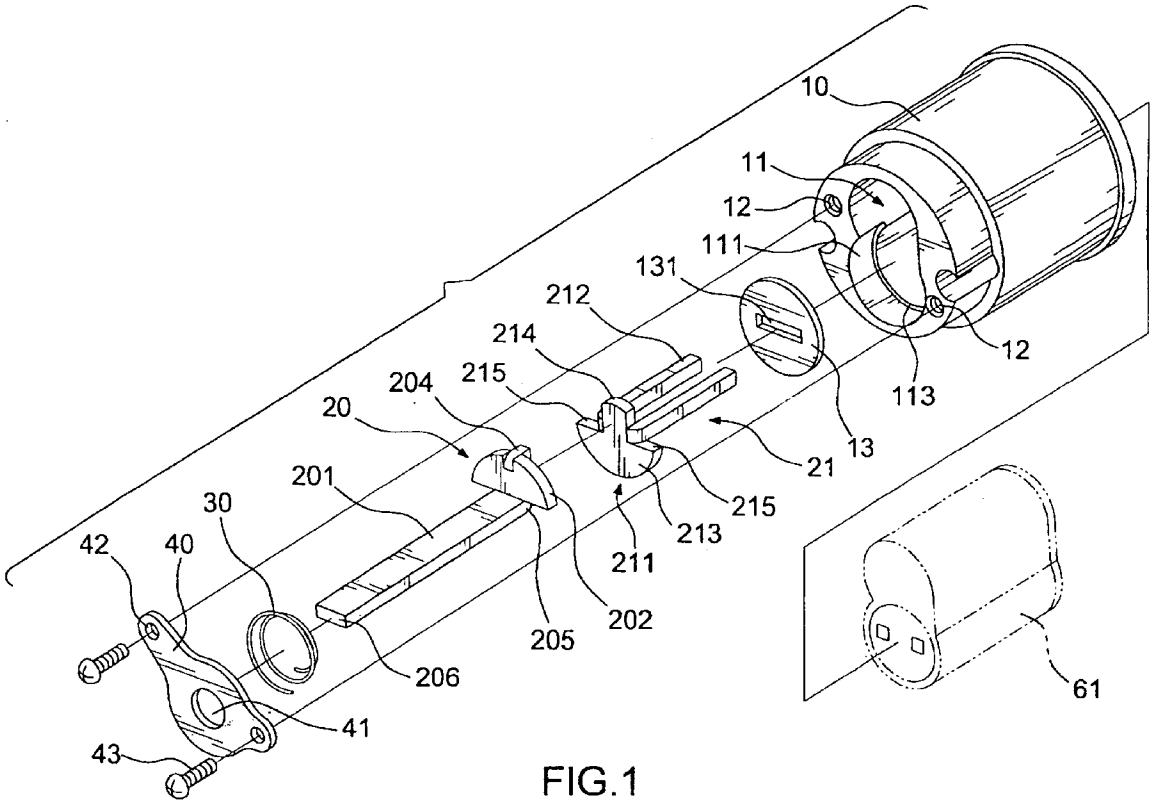
FIG. 1 is an exploded perspective view of a transmission apparatus in accordance with the present invention.
Figure 2:
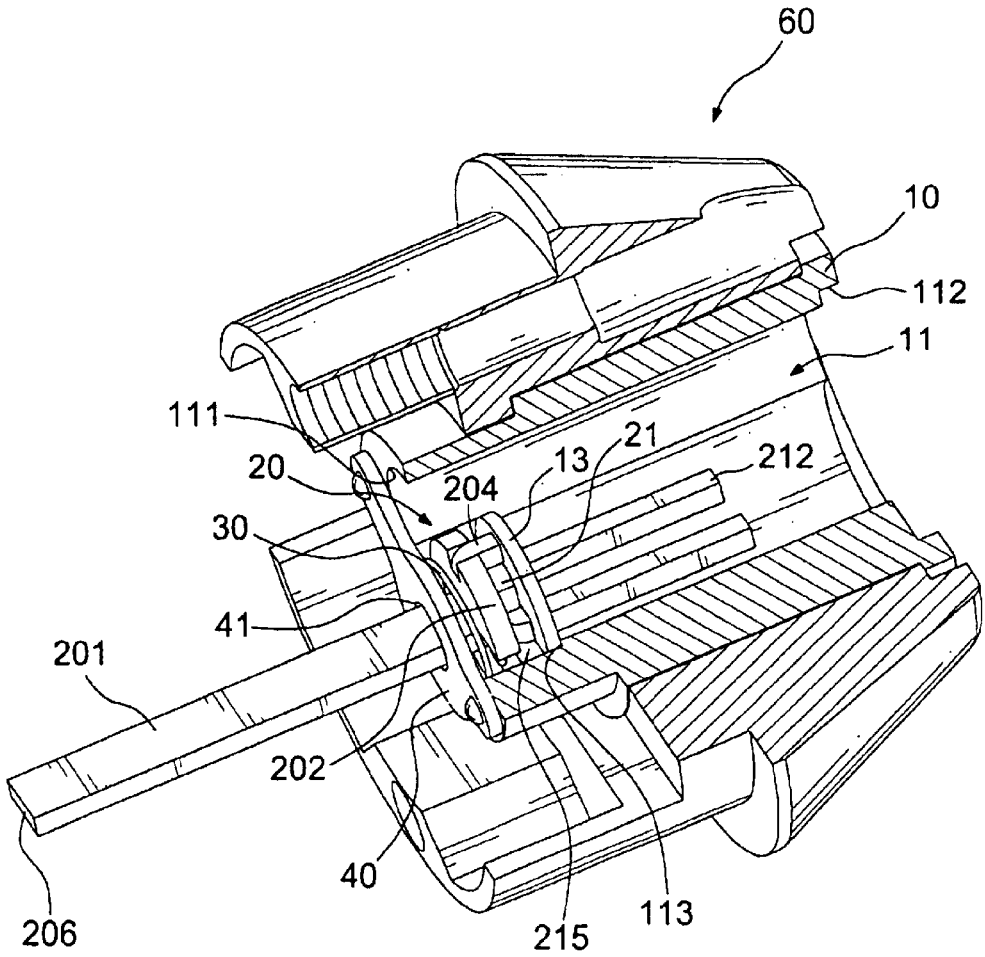
FIG. 2 is an operational perspective view in partial section of the transmission apparatus in FIG. 1 mounted in an outer housing of a supplemental lock.

With reference to FIGS. 1 and 2, a transmission apparatus to hold a lock core (61) of a supplemental lock in accordance with the present invention is mounted in an outer housing (60) of a supplemental lock. The transmission apparatus comprises an inner housing (10), an inner disk (13), a latch bolt coupler (20), a lock coupler (21), a restitution element (30) and a cover (40).

The inner housing (10) has a front (not numbered), a rear (not numbered) and a lock core chamber (11). The lock core chamber (11) is defined completely through the inner housing (10) and defines respectively a front opening (112) and a rear opening (11) in the front and the rear of the inner housing (10). The lock core chamber (11) has an inner shoulder (113) formed adjacent to the rear opening (111). The rear opening (111) has a figure eight shape that corresponds to the lock core (61). The inner housing (10) further has two threaded mounting holes (12). The threaded mounting holes (12) are diametrically defined in the rear of the inner housing (10).

The inner disk (13) is rotatably mounted in the lock core chamber (11), abuts the inner shoulder (I 13) in the inner housing (10) and has an elongated central through hole (131).

Figure 4:
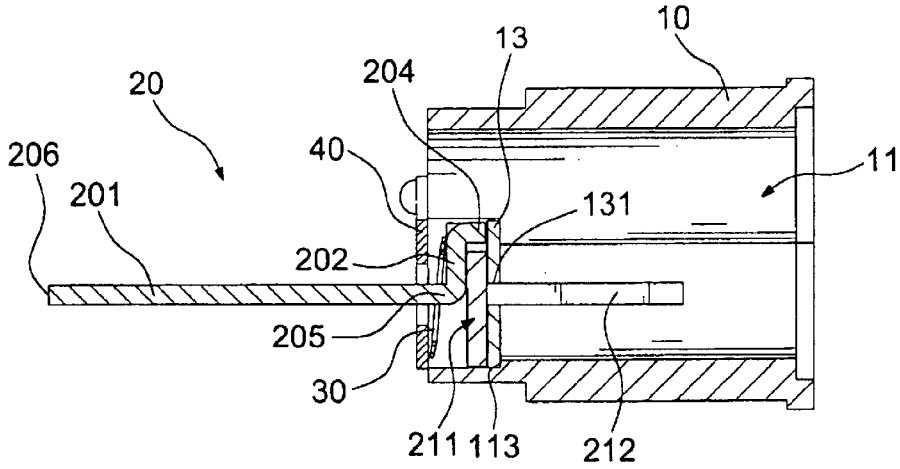
FIG. 4 is a cross sectional plan view of the transmission apparatus along 4—4 line in FIG. 3.
Figure 5:
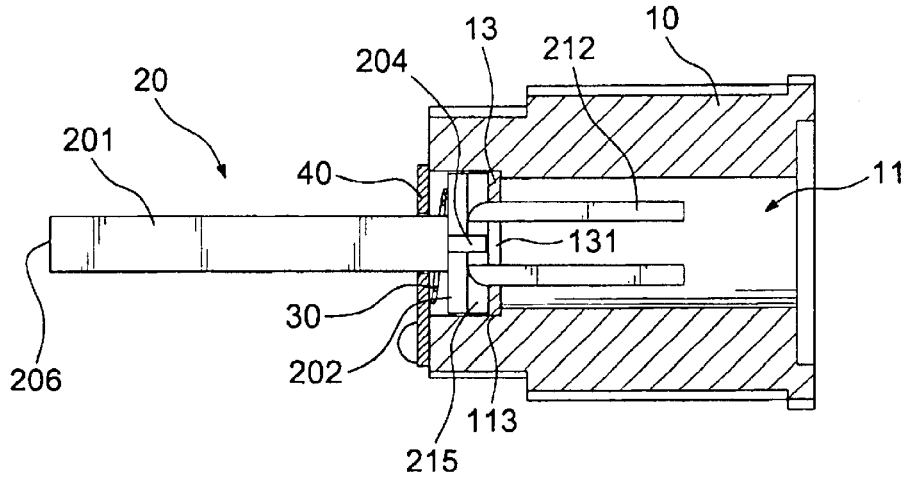
FIG. 5 is a cross sectional plan view of the transmission apparatus along 5—5 line in FIG. 3.

With further reference to FIGS. 4 and 5, the lock coupler (21) is attached to the inner disk (13) and comprises a rotatable outer disk coupler (211) and two lock coupling arms (212). The outer disk coupler (211) is attached to the inner disk (13) and has an outer semicircular coupling disk (213) and a radial extension (214). The outer semicircular coupling disk (213) has a flat edge (215). The radial extension (214) protrudes from the flat edge (215) of the outer semicircular coupling disk (213). The lock coupling arms (212) are attached to the outer disk coupler (211) alongside the radial extension (214) over the flat edge (215), extend toward the inner disk (13) and pass through the elongated though hole (131) in the inner disk (13). The lock coupling arms (212) extend into the lock core chamber (11) and connect to and are rotated by the lock core (61) in the lock core chamber (11).

The latch bolt coupler (20) is rotated by the lock coupler (21) and comprises a latch coupling arm (201), an inner semicircular disk (202) and a longitudinal tab (204). The latch coupling arm (201) has an inner end (205) and an outer end (206). The inner semicircular disk (202) is formed integrally with the latch coupling arm (201) at the inner end (205) and abuts on the outer disk coupler (211). The longitudinal tab (204) protrudes from the inner semicircular disk (202) over the radial extension (214) of the outer disk coupler (211) and corresponds to the flat edge (215) of the outer semicircular coupling disk (213). Therefore, the flat edge (215) of the outer semicircular coupling disk (213) will rotate the latch coupling arm (201) when the lock coupler (21) is rotated by the lock core (61) with the flat edge (215) pushing the longitudinal tab (204) of the latch bolt coupler (20). The inner semicircular disk (202) is attached to the outer disk coupler (211) to make the rotations of the entire latch bolt coupler (20) be smooth.

The restitution element (30) can be a coil spring and is mounted around the latch coupling arm (201) of the latch bolt coupler (20) to provide a restitution force on the inner semicircular disk (202) so that the inner semicircular disk (202) will firmly abut the outer disk coupler (211).

Figure 3:
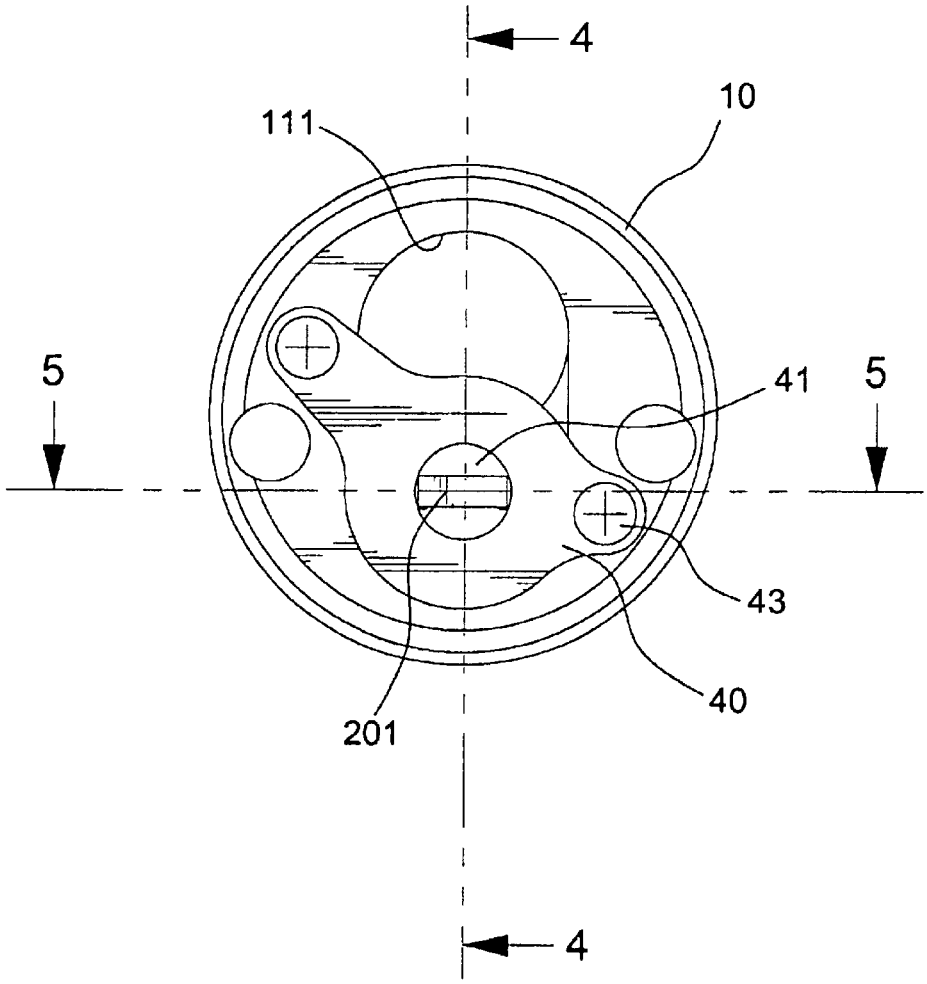
FIG. 3 is a rear plan view of the transmission apparatus in FIG. 1.

With further reference to FIG. 3, the cover (40) is attached to the rear of the inner housing (10) and has a latch coupling arm hole (41) and two mounting holes (42). The holes (41, 42) are formed completely through the cover (40). The latch coupling arm hole (41) is aligned with the outer end (206) of the latch coupling arm (201) so the outer end (206) of the latch coupling arm (201) extends out of the inner housing (10) through the latch coupling arm hole (41). The extended outer end (206) of the latch coupling arm (201) connects to a latch bolt (not shown) to drive the connected latch bolt that opens or closes the door. The mounting holes (42) are aligned respectively with the threaded mounting holes (12) in the inner housing (10) so that the cover (40) will be fastened on the rear of the inner housing (10) by two fasteners such as bolts (43).

With further reference to FIGS. 2, 6 and 7, the flat edge (215) on the outer disk coupler (211) abuts the longitudinal tab (204) of the latch bolt coupler (20) when the outer semicircular coupling disk (213) is rotated 90 degrees clockwise.

With reference to FIG. 8, further rotation of the outer semicircular coupling disk (213) 90 degrees clockwise will rotate the entire latch bolt coupler (20) including the latch coupling arm (201) 90 degrees so that the latch coupling arm (201) will drive the latch bolt and open the door.

With reference to FIG. 9, the outer semicircular coupling disk (213) is rotated counterclockwise 180 degrees so a person can remove the key from the lock core (61).

Consequently, assembling the apparatus in accordance with the present invention is more convenient than assembling a conventional one. The lock coupler (21) will be held by the inner disk (13). The latch bolt coupler (20) is held in position because the restitution element (30) provides a restitution force on the inner semicircular disk (202) to hold the entire latch bolt coupler (20) in place. The cover (40) holds the lock coupler (21), the latch bolt coupler (20), the restitution element (30) and the inner disk (13) in the lock core chamber (1) so that the entire transmission apparatus will be firmly held in the lock core chamber (11). The lock core (61) and other elements of the supplemental lock will be convenient to assemble.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A transmission apparatus to hold a lock core of a supplemental lock and the transmission apparatus comprising:

an inner housing having a front, a rear, a lock core chamber defined completely through the inner housing to define respectively a front opening and a rear opening respectively in the front and the rear of the inner housing to hold the lock core, and an inner shoulder formed adjacent to the rear opening;

an inner disk rotatably mounted in the lock core chamber, abutting the inner shoulder in the inner housing and having an elongated central through hole;

a lock coupler attached to the inner disk and comprising a rotatable outer disk coupler attached to the inner disk and two lock coupling arms extending from the outer disk coupler toward the inner disk and passing through the elongated central through hole in the inner disk;

a latch bolt coupler rotated by the lock coupler and comprising a latch coupling arm with an inner end and an outer end being rotated by the lock coupler when the lock coupler is rotated by the lock core;

a restitution element mounted around the latch coupling arm of the latch bolt coupler to provide a restitution force to hold the latch bolt coupler in place; and a cover attached to the rear of the inner housing, compressing the restitution element and having a latch coupling arm hole aligned with the outer end of the latch coupling arm to permit the outer end of the latch coupling arm to extend out of the inner housing.

2. The transmission apparatus as claimed in claim 1, wherein the outer disk coupler has an outer semicircular coupling disk with a flat edge and a radial extension protruding from the flat edge of the outer semicircular coupling disk, wherein the lock coupling arms are attached to the outer semicircular coupling disk alongside the radial extension over the flat edge; and the latch bolt coupler further comprises an inner semicircular disk integrally formed at the inner end of the latch coupling arm and abutting the outer semicircular coupling disk; and a longitudinal tab protruding from the inner semicircular disk toward the outer disk coupler over the radial extension of the outer disk coupler and corresponding to the flat edge of the outer semicircular coupling disk whereby the flat edge of the outer semicircular coupling disk will rotate the latch coupling arm when the lock coupler is rotated by the lock core with the flat edge pushing the longitudinal tab of the latch bolt coupler.

3. The transmission apparatus as claimed in claim 2, wherein the restitution element is a coil spring.

4. The transmission apparatus as claimed in claim 3, wherein the rear opening has a figure eight shape.

5. The transmission apparatus as claimed in claim 4, wherein the inner housing further has two threaded mounting holes defined in the rear; and the cover further has two mounting through holes aligned respectively with the threaded mounting holes so that the cover is fastened to the rear of the inner housing by two fasteners.

6. The transmission apparatus as claimed in claim 5, wherein the fasteners are bolts.

* * * * *